United States Patent [19]

Babb et al.

[11] 4,364,139

[45] Dec. 21, 1982

[54] DRUM TYPE SEWER CLEANER

[75] Inventors: Larry F. Babb, LaGrange; Walter J. Noveske, Elyria, both of Ohio

[73] Assignee: Emerson Electric Co., St. Louis, Mo.

[21] Appl. No.: 261,367

[22] Filed: May 7, 1981

[51] Int. Cl.[3] ..... B08B 9/02

[52] U.S. Cl. ..... 15/104.3 SN

[58] Field of Search ..... 15/104.3 R, 104.3 SN

[56] References Cited

U.S. PATENT DOCUMENTS

| | | | |
|---|---|---|---|
| 2,468,490 | 4/1949 | Joseph | 15/104.3 SN |
| 2,685,097 | 8/1954 | Allen | 15/104.3 SN |
| 2,730,740 | 1/1956 | O'Brien | 15/104.3 SN |
| 2,926,372 | 3/1960 | O'Brien | 15/104.3 SN |
| 3,048,870 | 8/1962 | Criscuolo | 15/104.3 SN |
| 3,077,314 | 2/1963 | Caperton | 15/104.3 SN |
| 3,246,354 | 4/1966 | Cooney et al. | 15/104.3 SN |
| 3,298,051 | 1/1967 | Ratliff | 15/104.3 SN |
| 3,747,153 | 7/1973 | O'Neill | 15/104.3 SN |

*Primary Examiner*—Edward L. Roberts

*Attorney, Agent, or Firm*—Polster, Polster and Lucchesi

[57] ABSTRACT

A sewer cleaning machine includes a rotatable drum containing a coiled cable, a motor for rotating the drum, a balanced double cable guide rotatable with respect to the drum, a forward cable guide support which is pivotally mounted for tilting the drum forward to drain or remove the drum, an auxiliary handle for lifting the drum, and easily removed shrouding for the drum and motor. The drum is formed of sheet metal and includes a rearwardly extending annular wall which is driven by a roller coaxially attached to the motor shaft by an adjustable clutch. The clutch can be infinitely adjusted from total slip to total lock, and the motor stall torque is chosen to be less than the torque required to break the cable. A handle is bent to provide balance for the machine when it is moved and to support the machine when it is turned on its back.

17 Claims, 6 Drawing Figures

DRUM TYPE SEWER CLEANER

BACKGROUND OF THE INVENTION

This invention relates to a sewer cleaning machine and in particular to such a machine in which a flexible plumber's cable is coiled in a rotatable drum and exits the drum through a cable guide which is rotatable with respect to the drum.

Drum type sewer cleaners are well-known. Examples of such devices are shown, for example in U.S. Pat. Nos. 2,167,268 (Sanger), 2,223,005 (Kerber), 2,468,490 (Di Joseph), 3,095,592 (Hunt), 3,246,354 (Cooney et al), 3,298,051 (Ratliff), 3,605,158 (Russell) and 3,747,153 (O'Neill).

Presently known drum type sewer cleaners have a number of drawbacks. They are bulky, and difficult to maneuver in tight places. They are noisy. They are subject to rapid corrosion and wear, particularly of the cable guide. The rotating drum is exposed to the operator, and is likely to scatter water when the machine is in operation if drainage openings are provided in the periphery of the drum. When rotation of the cable is stopped by an obstruction, the torque of the drive motor can kink or break the cable. Removing the drum for changing a cable or other maintenance frequently requires substantial disassembly of the machine, and lifting the heavy, cable-filled drum is difficult and awkward. Lifting the drum is made particularly difficult if the drum is of completely closed construction, because it is likely to contain a substantial amount of water from the sewer.

SUMMARY OF THE INVENTION

One of the objects of this invention is to provide a drum type sewer cleaner which is quieter and less subject to wear than previously known devices.

Another object is to provide such a sewer cleaner which is compact and relatively easy to maneuver.

Another object is to provide such a sewer cleaner whose rotating drum is both closed and shrouded.

Another object is to provide such a sewer cleaner whose drum is easily detached, drained and removed.

Another object is to provide such a sewer cleaner which prevents or reduces breaking and kinking of the cable.

Other objects will occur to those skilled in the art in light of the following description and accompanying drawings.

In accordance with one aspect of this invention, generally stated, a sewer cleaning machine is provided comprising a frame, a drum mounted on the frame for rotation about a generally horizontal axis, means for rotating the drun, a length of flexible cable in the drum, and a cable guide mounted coaxially with the drum for rotation with respect to the frame and with respect to the drum, the cable exiting the drum through a forward end of the cable guide, characterized by drum tilting means for tilting the drum and the cable guide forward with respect to the frame for removal and replacement of the drum with respect to the frame, the drum tilting means comprising a forward support structure, the forward support structure comprising forward bearing means for rotationally supporting the forward end of the cable guide and pivot means below the forward bearing means for pivotally mounting the forward support structure to the frame. Preferably, the forward bearing is mounted to the forward support means by an elastomeric material.

In accordance with another aspect of the invention, the drum comprises a sheet metal housing completely enclosing the cable within the drum, the housing including a rearwardly overhanging cable-containing part defining a generally horizontal internal drum surface, and the means for rotating the drum comprises a motor, the motor including a drive shaft and drive means on the drive shaft for drivingly engaging the internal drum surface. Preferably, the device further includes shroud means connected to the frame for covering the motor and the drum.

In accordance with another aspect of the invention, the drive means include a clutch assembly on the motor's drive shaft, the clutch assembly being adjusted to slip at a torque less than a torque sufficient to break the cable. Preferably, the clutch assembly includes a resilient drive cylinder, bearing means for mounting the drive cylinder coaxially with the drive shaft, skirt means carried by one of the shaft and the drive cylinder, and compression means carried by the other of the shaft and the drive cylinder for frictionally engaging the skirt means. The compression means comprise a disc plate and a clutch nut threaded to the periphery of the disc plate, with the skirt extending between the disc plate and the clutch nut, for varying the slip point between the compression means and the skirt means.

In accordance with another aspect of the invention, the drive motor has a break-down torque less than the torque required to break the cable. Preferably, the motor is a capacitor-start induction motor. Preferably, the motor is mounted to the frame by spring means, and adjustment means are associated with the spring means for adjusting the load on the drive means.

In accordance with another aspect of the invention, the shroud means comprise a first semi-cylindrical shroud part above the drum and a second pivotally-mounted shroud part below and in front of the drum.

Preferably, the machine further includes rearward axial bearing means for the drum and the cable guide, and release means for releasing the rearward axial bearing means from the drum and the cable guide to permit tilting the drum and cable guide forward with the forward support structure. Preferably, the rearward axial bearing means comprise a stub shaft and the release means comprise means for rearwardly retracting the stub shaft. Also preferably, the machine further comprises auxiliary handle means for lifting the drum when it is released from the frame, preferably in the form of a T-shaped handle attachable to the rearward axial bearing means on the drum. Preferably, the drum is proportioned to permit water to drain from the drum when the drum is tilted forward with the forward support structure.

In accordance with another aspect of the invention, the machine further comprises a pair of lower rearward wheels and a generally vertical rearward handle, the handle having a pair of arms attached to the frame, each of the arms being bent to form a rearwardly extending V, the point of the V being positioned to engage a horizontal surface when the machine is turned on its back. An upper cross-bar of the handle extends forward to provide balance for the machine when it is moved.

In accordance with another aspect of the invention, the cable guide includes a shield part and a tubular part, the shield part defining an interior wall of a cable housing for the coiled cable within the drum, the tubular part comprising an outlet part generally coaxial with the drum and a plurality of inlet parts communicating with the outlet part and through the shield part with the cable housing, the inlet parts of the tubular part being symmetrically arranged with respect to the axis of the drum, the cable extending through one of the inlet parts and through the outlet part. This arrangement balances the cable guide and in effect provides a spare inlet part, the part most subject to wear.

Optionally, a cable driving device may be provided in the front support structure.

Other aspects of the invention will best be understood in light of the following description of the preferred embodiment of the invention.

DESCRIPTION OF THE PREFERRED EMBODIMENT

Figure 1:
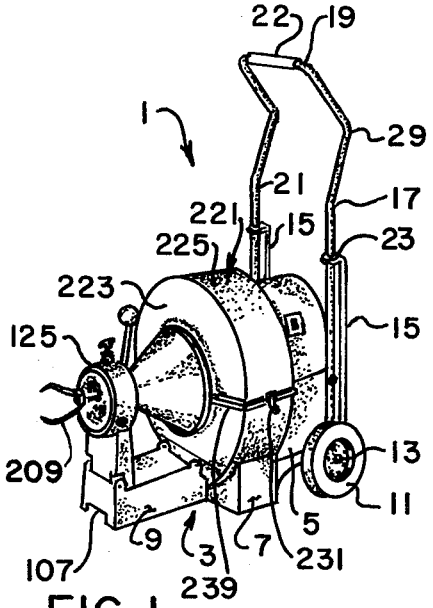
FIG. 1 is a view in perspective of one illustrative embodiment of drum type sewer cleaning machine of the present invention.

Referring now to the drawings, reference numeral 1 indicates a drum type sewer cleaning machine of the present invention. The machine 1 includes a cast aluminum frame 3 having a rearward portion 5, a transverse central base portion 7, and a forward base portion 9.

A pair of wheels 11 are rotatably mounted on the lower end of rearward portion 5 of the frame 3 by axle 13. Two spaced-apart vertical skids 15 are held by screws to the lower side of the rearward portion 5.

A handle 17 is also mounted on the rearward portion 5. The handle 17 is formed as a U, and has a cross bar 19 and a pair of parallel arms 21. An elastomeric sleeve 22 is provided on the cross bar 19. Forwardly bent portions 23 at the upper ends of the skids 15 include apertures for arms 21 of the handle 17. A pair of bosses 25 on either side of the rearward frame portion 5 guide and support the arms 21 of the handle 17. The handle 17 is secured to the frame 5 by means of large-knobbed hand screws 27. Each of the arms 21 includes a V-shaped portion 29, the point of which extends rearwardly when the machine is upright. As will become apparent, when the machine is turned on its back, the apexes of the V-shaped portions 29 engage the ground and provide a stable support for the machine. The upper cross-bar 19 of the handle 17 extends forwardly and provides balance for the machine when it is tilted back and rolled on wheels 11.

On the upper face of the rearward frame portion 5 is mounted a retractable stub shaft assembly 31. The stub shaft assembly 31 includes a pillow block 33 bolted to the frame, a shaft 35 journaled for reciprocal movemem t in the pillow block 33, and a cam handle 37 pivotally connected to the rearward end of shaft 35. The cam handle 37 is movable between a first stop position in which the shaft 35 is forwardly extended and a second stop position in which the shaft is retracted, for purposes which will become apparent.

Also on the upper face of the rearward frame portion 5, at one side of the upper face, are a pair of protrusions 39 between which is pivotally mounted a motor-mounting table 41. The other side of the table 41 is slotted to receive a pair of vertical studs 43, the lower ends of which are threaded into the upper face of the rearward frame portion 5 and the upper ends of which are threaded to receive adjustment nuts 45. The table 41 rests on compression springs 47 carried on the studs 43, for purposes which will become apparent.

Mounted on the table 41 is a capacitor-start induction motor 49. The motor 49 is rated at one-third horsepower at 1725 RPM.

On the forwardly extending output shaft 51 of the motor 49 is mounted an adjustable slip-clutch assembly 53 and a drive roller 55. The roller 55 is a urethane sleeve.

Figures 3, 6:
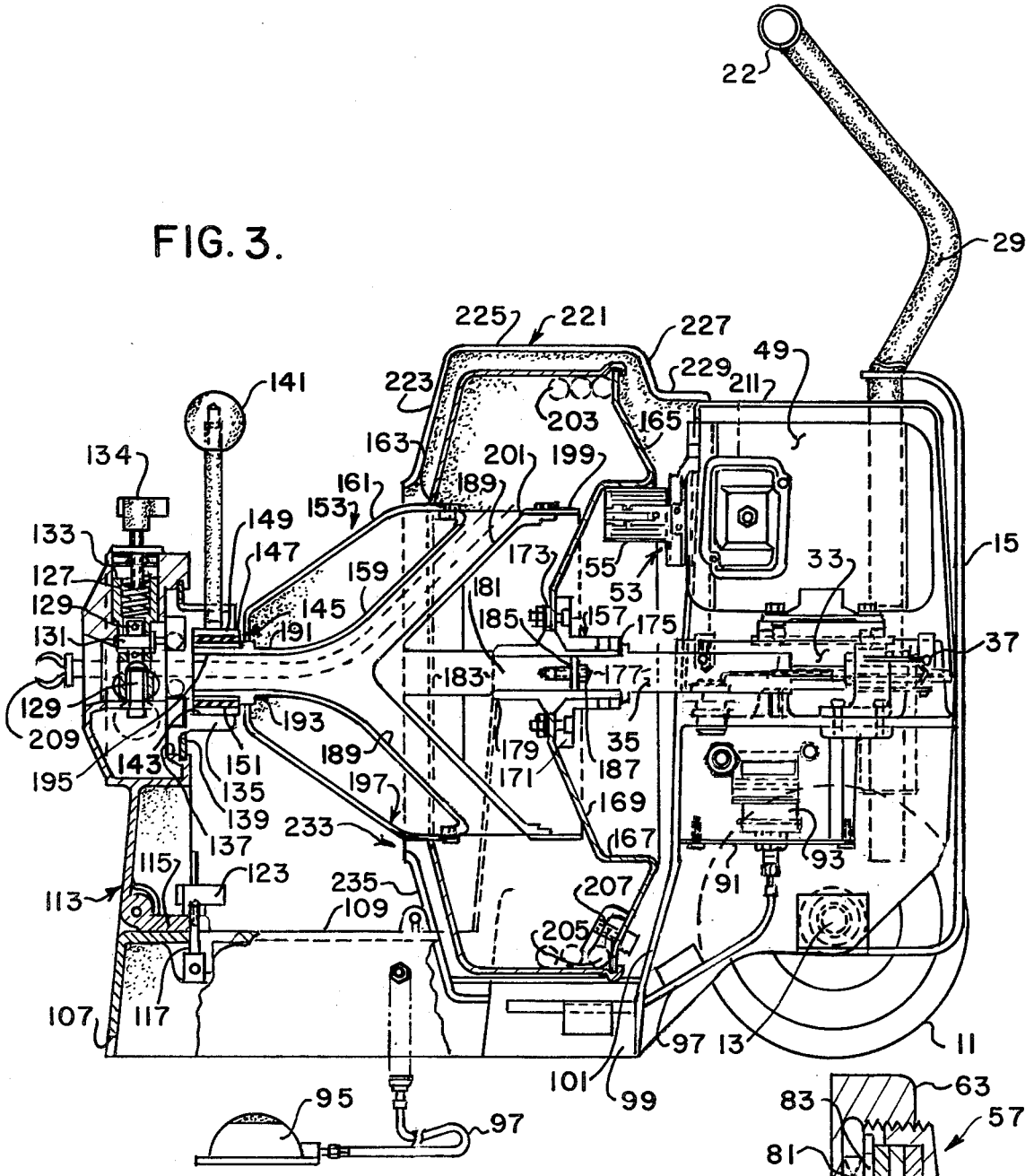
FIG. 3 is a partially sectional view in side elevation of the machine of FIG. 1.
FIG. 6 is a sectional view of a clutch assembly of the machine of FIG. 1.
Figure 4:
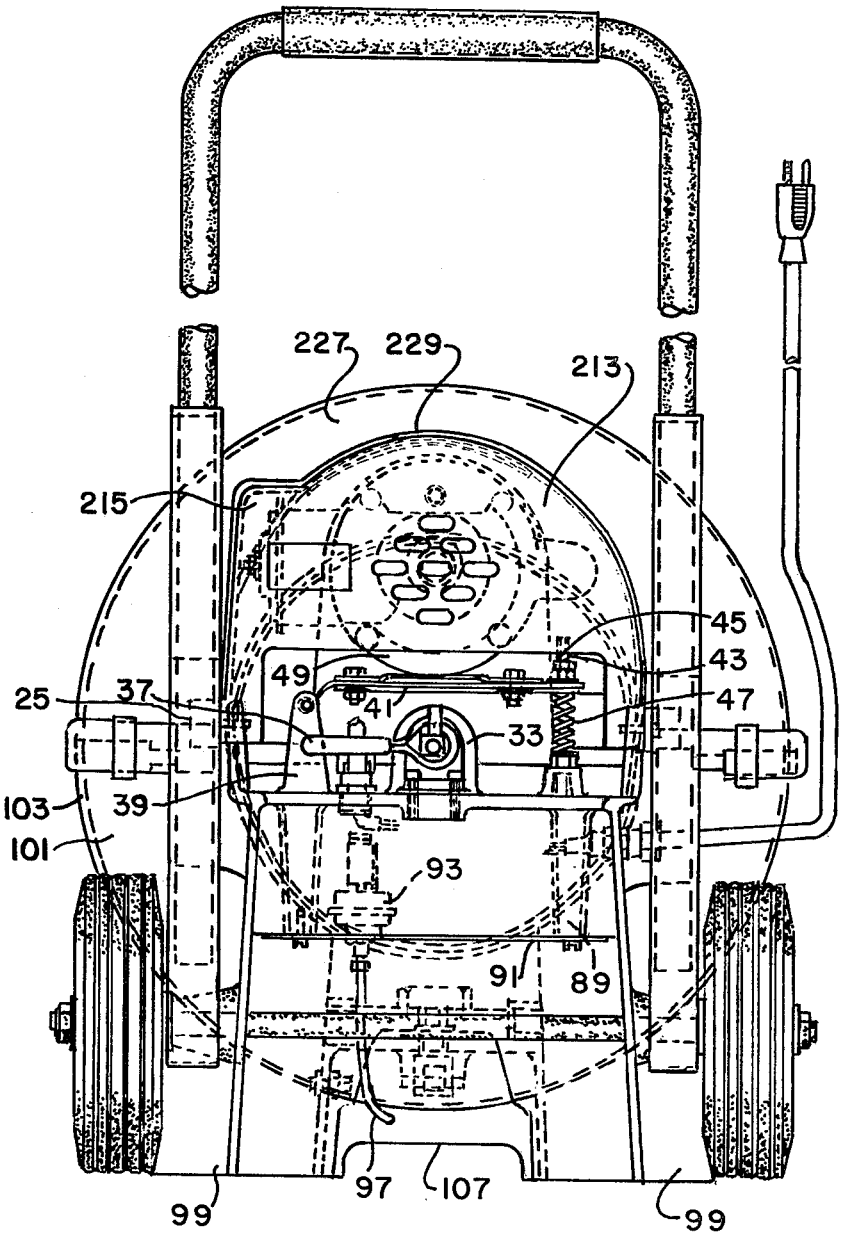
FIG. 4 is a view in rear elevation of the machine in FIG. 1.
Figure 5:
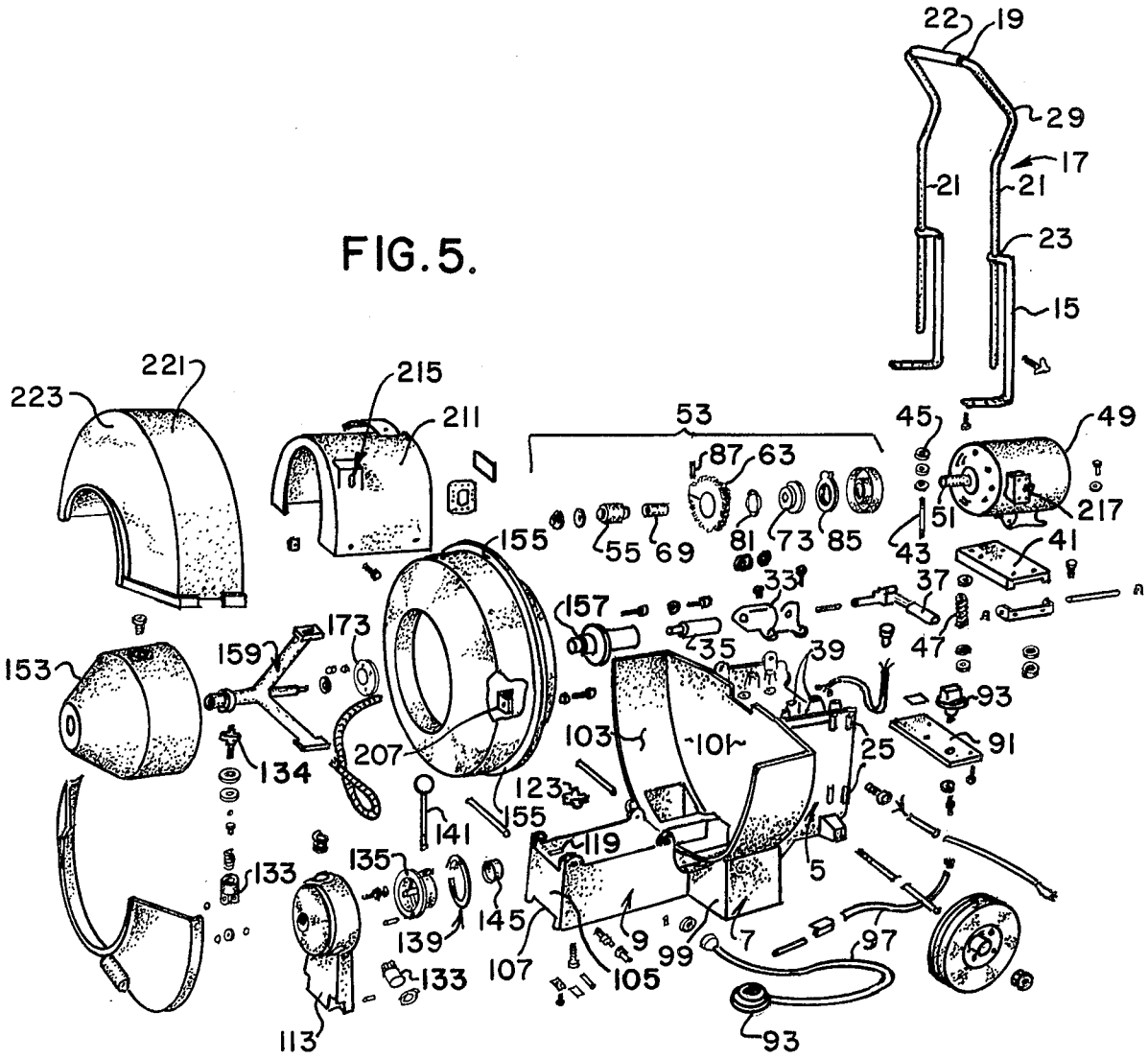
FIG. 5 is an exploded view in perspective of the machine of FIG. 1.

As shown particularly in FIG. 6, the slip-clutch assembly includes a drive assembly 57 and a driven assembly 59 operatively connected by an adjustable friction connection. The drive assembly 57 includes the motor shaft 51, a clutch disc plate 61, and a clutch nut 63 threaded to the periphery of the disc plate 61. The disc plate 61 is held against rotation with respect to the motor shaft 51 by a pair of balls 65 trapped between dimples in the shaft 51 and slots 67 in the clutch disc plate 61. The driven assembly 59 includes a bearing 69, a thrust housing 71 secured on the bearing 69 and a clutch plate 73 secured on the bearing 69. The bearing 69 and thrust housing 71 mount the drive roller 55 coaxially with the motor shaft 51. A retaining plug 75, held to the end of drive shaft 43 by a screw 77, holds the driven assembly axially on the drive shaft 51. The clutch plate 73 includes a skirt 79 which extends between the disc plate 61 and the clutch nut 63. A wave spring washer 81, a clutch washer 83 and a pair of clutch discs 85 are also interposed between the disc plate 61 and the clutch nut 63. It will be seen that tightening or loosening the clutch nut 63 on the disc plate 61 changes the force exerted by spring washer 81, and therefore changes the frictional force between the pads 85 and the skirt 79. Therefore, turning the clutch nut 63 with respect to the disc plate 61 permits infinite adjustment of the torque required to cause the driven assembly 59 to slip with respect to the drive assembly 57, from very little to more than is required to stall motor 49. The drive assembly 57 may be held against rotation during adjustment of the clutch nut 63 by holding a screwdriver in the screw 77. The clutch nut 63 is radially split, and a chordal screw 87, extending across the split, permits the clutch nut 63 to be locked at any predetermined slippage torque.

Mounted on the rearward frame portion 5 on downward protrusions 89 is a switch plate 91, which carries a pneumatic switch 93. The switch 93 is connected electrically in series with the motor 49 and is normally open. A foot actuator 95, in the form of a squeeze bulb, is connected to the switch 93 by a hose 97. Depression of the actuator 95 permits the motor 49 to operate. It will be seen that this arrangement automatically stops the motor should any leak develop in the actuator 95 or hose 97, or should the hose 97 become disconnected.

The central base portion 7 of the cast frame 3 includes a pair of transverse integral box-frame legs 99, a vertical semi-circular guard plate 101, and a semi-cylindrical rim guard 103.

The forward base portion 9 includes a forwardly extending box-frame leg 105 which forms with the transverse legs 99 a T-shaped three-point support for the machine 1. A lower cut-out 107 at the forward end of the leg 105 provides a hand hold for maneuvering the machine 1 or for aiding in loading it into a truck or van.

At the forward end of the upper deck 109 of the forward base portion 9 are a pair of bosses 111 between which is pivotally mounted a forward support structure 113, cast of aluminum. An integral horizontal foot part 115 on the support casting 113 prevents it from pivoting rearward. A clamp 117 is pivoted to the forward base portion 9 below the deck 109. The clamp 117 extends through an aperture 119 in the deck 109 and through a slot 121 in the foot part 115. A knob 123 threaded to the upper end of the clamp 117 clamps the foot part 115 to the deck 109 and holds the support structure 113 upright. Loosening of the knob 123 permits the clamp to be pivoted rearwardly thereby releasing the support structure to pivot forward.

The forward support structure 113 as illustrated includes at its upper end an optional cable feed mechanism 125. The cable feed mechanism may, for example, be similar to that shown in Tucker, U.S. Pat. No. 3,394,599 or Jones, U.S. Pat. No. 2,918,962. Briefly, the cable feed mechanism 125 includes three roller assemblies 127 mounted in radial bores in the support structure 113. Each roller assembly includes a roller 129 carried on a shaft 131 journaled in a yoke structure 133. The upper yoke structures 133 is spring biased inwardly and the pressure of the spring is adjustable by means of a knob 134 to accommodate cables of different sizes. Each yoke structure 133 is rotatable within its bore. The shafts 131 extend rearwardly into slots in a feed actuator casting 135. The feed actuator casting 135 is rotatably mounted in a recess 137 in the rear face of the support structure 113 and is trapped by a snap ring 139. Rotation of the feed actuator casting 135 by a handle 141 causes the three roller assemblies 127 to rotate simultaneously and equally within their bores. As is well known, this arrangement of rollers on the outside surface of a rotating body (such as a sewer cable) allows selective conversion of rotational motion to axial motion, depending on the angle of the rollers with respect to the rotating body.

The feed actuator casting 135 includes a central seat 143 in which is mounted a sleeve bearing 145. The bearing assembly 145 includes an inner bearing 147, an outer shell 149 and an annular resilient urethane sleeve 151 between the bearing 147 and shell 149. It will be appreciated that if the feed mechanism is omitted, the feed actuator casting 135 may be formed integral with the support structure 113.

Rotatably supported between the bearing assembly 145 on the support structure 113 and the retractable stub shaft 35 on the rearward portion 5 of the casting 3 is a drum assembly 153. The drum assembly 153 includes a sheet metal drum 155, a rear bearing assembly 157, a bifurcated cable guide 159 and a cable guide housing 161.

The forward face of the drum 155 tapers forwardly toward its center and includes a central opening 163. The rear face of the drum 155 includes a rearwardly overhanging cable-containing part 165 defining an annular, generally horizontal, internal drum surface 167, and a forwardly tapering central part 169 to which the rear bearing assembly 157 is attached. The urethane drive sleeve 55 on the clutch assembly 53 engages the internal drum surface with a force determined by the setting of nuts 45 which position the motor 49 and by the force of springs 47.

The rear bearing assembly 157 includes a hub 171 bolted to the central part 169 of the drum 155. A corresponding stiffening plate 173 is provided on the inner face of the drum. A bearing 175 at the rear of the hub 171 receives a reduced neck portion 177 at the distal end of the shaft 35. At its forward end, the hub 171 is provided with a bearing 179 of smaller diameter than the bearing 175, and coaxially with the bearing 175.

A reduced end 181 of an axial shaft part 183 of the cable guide 159 is journalled in the bearing 179 and is held in the hub 171 by a thrust washer 185 and tapped bolt 187. The cable guide 159 further includes a pair of diametrically opposed input tubes 189 and an axially forwardly extending output tube 191 communicating with both of the tubes 189. The forward end of the output tube 191 is provided with a boss 193, which bears against the forward bearing assembly 145, and a distal end 195 of increased wall thickness journalled in the forward bearing assembly 145.

The cable guide housing 161 includes a generally conical forward part 197 and a generally cylindrical rearward part 199. The input tubes 189 of the cable guide are bolted to the rearward part 199 of the cable guide housing 161. Openings 201 are provided in the cable guide housing at the open ends of the input tubes 189 of the cable guide 159. The openings 201 are slightly larger than the openings at the ends of the input tubes 189 in order to reduce wear on the cable guide housing. The diameter of the cylindrical part 199 of the cable guide housing 161 is slightly smaller than the opening 163 in the forward face of the drum 155, in order to provide drainage when the drum assembly is tilted forward. A cable 203 is coiled in the drum 155. A pigtail 205 of the cable 203 is held by a clamp 207 in the drum. The other end of the cable 203 is led through one of the input tubes 189 of the cable guide 159, through the output portion 191 of the cable guide, and through the feed mechanism 125. A sewer cleaning tool 209 is provided on the free end of the cable 203.

A plastic shroud 211 is provided over the motor 49. The shroud 211 is formed as a semi-cylindrical arch having a generally open front and a semi-circular back face 213. Ventilation holes are provided in the rear face 213. The rear face 213 terminates above the cam handle 37 to permit easy access to it. A protuberance 215 is provided on one side of the motor shroud 211 to accomodate a forward/off/reverse switch 217 for the motor 49. An access opening 219 is provided in the protuberance 215 for access to the switch 217. The motor shroud 211 is held by screws to the rearward portion 5 of the frame 3.

A semi-cylindrical removable shroud 221 is provided over the drum 155. The upper drum shroud 221 includes a front wall 223, an axially extending rim guard part 225, a rear wall 227 and a rearwardly extending lip 229. The lip 229 conforms to the shape of the motor shroud 211 and overlaps it. The upper drum shroud 221 is held to the semi-cylindrical rim guard 103 of the frame 3 by a pair of draw pull catches 231.

A lower drum shroud 233 is pivoted to the upper deck 109 of the forward portion 9 of the frame 3. The lower shroud 233 includes a semi-circular front wall 235 and a rim guard part 237. A downwardly extending lip 239 on the upper drum shroud 221 overlaps the lower drum shroud and prevents it from pivoting forward.

It will be seen that the shrouds 211, 221 and 233, together with the guard plate 101 and the rim guard 103 on the base 3 provide substantially complete coverage of the drum 155 and motor 49, yet are extremely compact. As described hereinafter, the shrouds 221 and 233 are also easily moved to permit removal of the drum assembly 153.

In operation, the machine 3 is positioned within three feet of the sewer inlet, and the power cord for the motor 49 is plugged into a receptacle. An appropriate tool 209 is installed on the end of the cable 203. The feed knob 134 is loosened and sufficient cable is pulled from the drum assembly 153 to start the tool 209 and cable 203 into the sewer inlet. The feed knob 134 is tightened, the switch 217 is moved to the "forward" position and the cable 203 is grasped with a mitten. The foot actuator 93 is depressed to start the motor 49 rotating, thereby rotating the drum 155 and the cable 203. Moving the feed lever 141 in the direction of rotation of the drum 155 and cable 203 cants the rollers 129 and causes the cable to be feed at a variable rate of from zero to thirty feet per minute.

When resistance is encountered because the tool 209 has reached an obstruction, the feed lever 141 is moved in the opposite direction to the full "reverse" position and the foot actuator 93 is released to stop rotation of the drum 155.

Should the cable become "hung up" on the obstruction, the drum 155 is allowed to come to a complete stop, the switch 217 is moved to its "reverse" position, the feed knob 134 is loosened, and the cable 203 is pulled while jogging the foot actuator 93. This is the only condition under which the motor 49 is run in reverse. If the cable becomes hung up and is not freed, the clutch assembly 57 will begin to slip before the cable 203 breaks. Should the clutch assembly 57 have been set at too high a release torque, the motor 49 will stall before the cable 203 breaks.

Obstructions are cleared by releasing the feed knob 134 and manually feeding the cable into the obstruction. Preferably the cable is pumped by depressing the foot actuator 93 while applying intermittent downward pressure on the loop of cable between the machine 1 and the sewer inlet.

When all obstructions have been cleared, the feed lever 141 is moved to its reverse position, and the cable feeds itself into the drum 155. Preferably, a continuous flush of water is used to clean the cable and the tool 209 as they are retrieved. Before the tool 209 is extracted from the sewer, the foot actuator 93 is released and the drum 155 is allowed to come to a complete stop. The switch 217 is turned to the "off" position and the machine is unplugged. The feed knob 134 is loosened and the remaining cable is removed from the sewer and hand-fed into the machine.

It will be appreciated that the cable 203 may be fed entirely manually if desired or if the machine is not equipped with the optional drive mechanism 125.

Because of the urethane mounting of the front bearing assembly 145, the urethane drive roller 55 and the spring mounting of the motor 49, the operation of the machine is relatively quiet.

The machine 1 is easily moved by tilting it backwards about 45° by means of handle 17. When thus tilted, the machine 1 is well balanced and easily moved. The skids 15 have been found to provide easier transportation up and down steps than the conventional belt-type climbers. To load the machine on a truck, the machine is tilted backwards to rest the apexes 29 of the handle arms 21 on the bed of the truck. The front of the machine is lifted by hand hold 107 in the front casting portion 9, and the machine is slid onto the truck. For use of the machine 1 in places which require the cable to exit the machine vertically, the machine is simply tilted onto the handle apexes 29.

Figure 2:
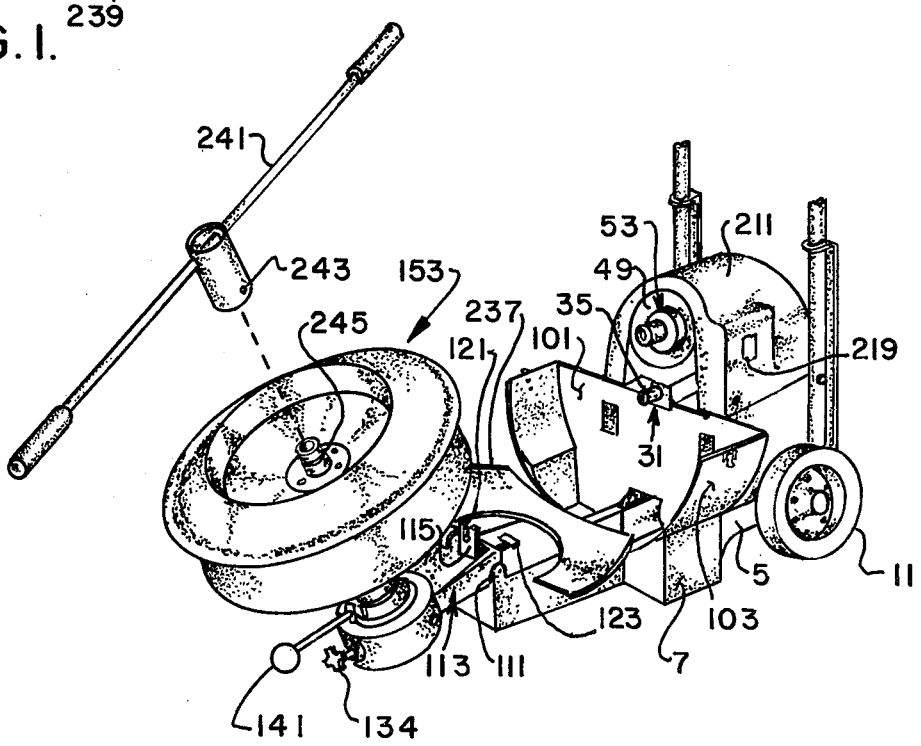
FIG. 2 is a view in perspective corresponding to FIG. 1, showing a forward support structure of the machine of FIG. 1 tilted forward for draining a drum carried thereby or for removal of the drum with an auxiliary handle.

The drum assembly 153 is easily drained, removed and replaced. The latches 231 are released from the upper drum shroud 221, and the shroud 221 is removed. The cam handle 37 is turned from the left to the right side of the machine to retract the stub shaft 35. The feed mechanism 125 is disengaged by loosening the knob 134. The front support structure retaining knob 123 is loosened and the clamp 117 is rotated back to release the front support structure 113. Pulling the top of the drum 155 forward pivots the drum assembly 153 and the front support structure 113 forward to a horizontal position as shown in FIG. 2. Water in the drum 155 drains out through the opening 163 in the front of the drum. The drum assembly 153 may be lifted off the front support structure, where it is held in the bearing assembly 145 by the front portion 195 of the cable guide 159. Because the drum 155 may contain as much as one hundred feet of three-quarter inch inner-core cable, an auxiliary handle 241 is provided for ease and convenience when handling the drum 155. The handle 241 is provided with catches 243 for engagement with openings 245 in the drum hub 171.

A new drum is easily mounted on the machine by reversing the foregoing procedure.

When it is desired to change the cable in a drum, the old cable is drawn from the drum until the pigtail 205 emerges, and a new cable is attached to the pigtail 205 by a coupler. The new cable is then manually retracted into the drum. Periodically, the pigtail 205 may be loosened from the clamp 207 and rethreaded through the other inlet tube 189. This procedure increases the life of the cable guide 159. It will be seen that the provision of two inlet tubes 189 also provides better balace for the rotating cable guide 159, which rotates at a different rate from the drum 155 whenever cable is being extracted or retracted.

The clutch 53 may be adjusted as previously described, for the purpose of accommodating its slippage characteristics to a particular cable or simply for the purpose of adjusting the operating characteristics of the machine under load conditions to the feel or style preferred by an operator. Because of the characteristics of the motor 49, the adjustment of the clutch is far less critical than with prior machines. Numerous variations in the sewer cleaning machine of the present invention, within the scope of the appended claims, will occur to those skilled in the art in light of the foregoing disclosure.

We claim:

1. In a sewer cleaning machine comprising a frame, a drum mounted on said frame for rotation about a generally horizontal axis, means for rotating said drum, a length of flexible cable in said drum, and a cable guide mounted coaxially with said drum for rotation with respect to said frame and with respect to said drum, said cable exiting said drum through a forward end of said cable guide, the improvement comprising drum tilting means for tilting said drum and said cable guide forward with respect to said frame for removal and replacement of said drum with respect to said frame, said drum tilting means comprising a forward support structure, said forward support structure comprising forward bearing means for rotationally supporting said forward end of said cable guide and pivot means below said forward bearing means for pivotally mounting said forward support structure to said frame.

2. In a sewer cleaning machine comprising a frame, a drum mounted on said frame for rotation about a generally horizontal axis, means for rotating said drum, a length of flexible cable in said drum, and a cable guide mounted coaxially with said drum for rotation with respect to said frame and with respect to said drum, said cable exiting said drum through a forward end of said cable guide, the improvement wherein said drum comprises a sheet metal housing completely enclosing said cable within said drum, said housing including a rearwardly overhanging cable-containing part defining a generally horizontal internal drum surface, and wherein said means for rotating said drum comprises a motor, said motor including a drive shaft and drive means on said drive shaft for drivingly engaging said internal drum surface, and further comprising shroud means connected to said frame for covering said motor and said drum, said shroud means comprising a first semi-cylindrical shroud part above said drum and a second pivotally mounted shroud part in front of said drum.

3. In a sewer cleaning machine comprising a frame, a drum mounted on said frame for rotation about a generally horizontal axis, means for rotating said drum, a length of flexible cable in said drum, and a cable guide mounted coaxially with said drum for rotation with respect to said frame and with respect to said drum, said cable exiting said drum through a forward end of said cable guide, the improvement wherein said drum comprises a rearwardly overhanging part defining a generally horizontal internal annular drive surface, and wherein said means for rotating said drum comprises a motor, said motor including a drive shaft and drive means on said drive shaft for drivingly engaging said drive surface, said machine further comprising shroud means connected to said frame for covering said motor and said drum, said shroud means comprising a first generally semi-cylindrical shroud part above said drum and a second pivotally-mounted shroud part below and in front of said drum.

4. In a sewer cleaning machine comprising a frame, a drum mounted on said frame for rotation about a generally horizontal axis, means for rotating said drum, a length of flexible cable in said drum, and a cable guide mounted coaxially with said drum for rotation with respect to said frame and with respect to said drum, said cable exiting said drum through a forward end of said cable guide, the improvement wherein said drum comprises a rearwardly overhanging part defining a generally horizontal internal annular drive surface, and wherein said means for rotating said drum comprises drive means for drivingly engaging said drive surface, said machine further comprising drum tilting means for tilting said drum and said cable guide forward with respect to said frame, said drum tilting means comprising a forward support structure, said forward support structure comprising forward bearing means for rotationally supporting said forward end of said cable guide and pivot means below said forward bearing means for pivotally mounting said forward support structure to said frame.

5. The improvement of claim 4 wherein said machine further includes rearward axial bearing means for said drum and said cable guide, and release means for releasing said rearward axial bearing means from said drum and said cable guide to permit tilting said drum and cable guide forward with said forward support structure.

6. The improvement of claim 5 wherein said rearward axial bearing means comprise a stub shaft and said release means comprise means for rearwardly retracting said stub shaft.

7. The improvement of claim 5 wherein said machine further comprises auxiliary handle means for lifting said drum when it is released from said frame.

8. The improvement of claim 7 wherein said rearward axial bearing means comprises attachment means for attaching said auxiliary handle means to said drum.

9. The improvement of claim 4 wherein said drive means comprise a motor, said motor having a shaft operatively engaging said drive surface of said drum, spring means for mounting said motor to said frame, and adjustment means associated with said spring means for adjusting the load on said drive means.

10. The improvement of claim 4 wherein said machine further comprises a pair of lower rearward wheels and a generally vertical rearward handle, said handle having a pair of arms attached to said frame, each of said arms being bent to form a rearwardly extending V, the point of each said V being positioned to engage a horizontal surface when said machine is turned on its back.

11. The improvement of claim 4 wherein said forward bearing is mounted to said forward support means by an elastomeric material.

12. The improvement of claim 4 wherein said cable guide includes a tubular part and a shield part, said cable extending through said tubular part, said shield part defining an interior wall of a cable housing for the coiled cable within said drum.

13. The improvement of claim 4 wherein said cable guide includes a shield part and a tubular part, said shield part defining an interior wall of a cable housing for the coiled cable within said drum, said tubular part comprising an outlet part generally coaxial with said drum and a plurality of inlet parts communicating with said outlet part and through said shield part with said cable housing, said inlet parts of said tubular part being symmetrically arranged with respect to the axis of said drum, said cable extending through one of said inlet parts and through said outlet part.

14. The improvement of claim 4 wherein said drum is proportioned to permit water to drain from said drum when said drum is tilted forward with said forward support structure.

15. In a sewer cleaning machine comprising a frame, a drum mounted on said frame for rotation about a generally horizontal axis, means for rotating said drum, a length of flexible cable in said drum, and a cable guide mounted coaxially with said drum for rotation with respect to said frame and with respect to said drum, said cable exiting said drum through a forward end of said cable guide, the improvement wherein said drum comprises a rearwardly overhanging part defining a generally horizontal internal annular drive surface, and wherein said means for rotating said drum comprises a motor, said motor including a drive shaft and drive means on said drive shaft for drivingly engaging said drive surface, and spring means for biasing said drive means into engagement with said drive surface.

16. The improvement of claim 15 wherein said motor is mounted on a pivot on said frame, said spring means biasing said motor about said pivot.

17. The improvement of claim 15 wherein said drive means comprises a sleeve of yieldable material engaging said drive surfaces.

* * * * *